US005078567A

United States Patent [19]

Lombardo

[11] Patent Number: 5,078,567

[45] Date of Patent: Jan. 7, 1992

[54] TRUCK WITH MULTIPLE STORAGE COMPARTMENTS FOR SEPARATELY RECEIVING AND DISCHARGING RECYCLABLE MATERIALS

[76] Inventor: Santo J. Lombardo, 141 Mountain Rd., Glastonbury, Conn. 06033

[21] Appl. No.: 569,399

[22] Filed: Aug. 17, 1990

[51] Int. Cl.[5] ..... B65F 3/00

[52] U.S. Cl. ..... 414/525.6; 296/24.1; 220/909; 414/517; 414/786; 298/17 R

[58] Field of Search ..... 414/517, 519, 520, 525.1, 414/406, 407, 408, 409, 786, 525.6; 296/24.1, 183; 298/1 R, 17 R; 220/909, 529; 222/166

[56] References Cited

U.S. PATENT DOCUMENTS

| | | | |
|---|---|---|---|
| 1,650,249 | 11/1927 | Venable . | |
| 3,378,302 | 4/1968 | Doeglas et al. . | |
| 3,409,328 | 11/1968 | Hamby et al. . | |
| 3,498,486 | 3/1970 | Freeman, Jr. . | |
| 4,242,953 | 1/1981 | St. Gelais . | |
| 4,425,070 | 1/1984 | Howells et al. . | |
| 4,470,747 | 9/1984 | Tichenor . | |
| 4,666,211 | 5/1987 | Smith et al. . | |
| 4,775,283 | 10/1988 | Krapp et al. . | |
| 4,840,531 | 6/1989 | Dinneen | 414/409 |
| 4,915,570 | 4/1990 | Rath et al. | 414/409 |
| 5,035,563 | 7/1991 | Mezey | 414/409 |

FOREIGN PATENT DOCUMENTS

| | | |
|---|---|---|
| 7719418 | 1/1979 | France . |
| 187070 | 10/1922 | United Kingdom . |

*Primary Examiner*—Frank E. Werner
*Assistant Examiner*—James Ellen

[57] ABSTRACT

A truck for separately storing and discharging recyclable materials has a container housing with at least one door in its rear wall. Partitioning members divide the interior space of the container housing into at least two pairs of transversely disposed compartments, one pair being disposed rearwardly of the other pair, and the rearward pair being spaced from said rear wall of the housing to define a fifth compartment. The partitioning members have gates therein, and a multiplicity of openings are provided in one side wall of the container housing for feeding different types of materials into the several compartments in which they may be separately stored and from which they may be separately discharged.

24 Claims, 6 Drawing Sheets

FIG. 4
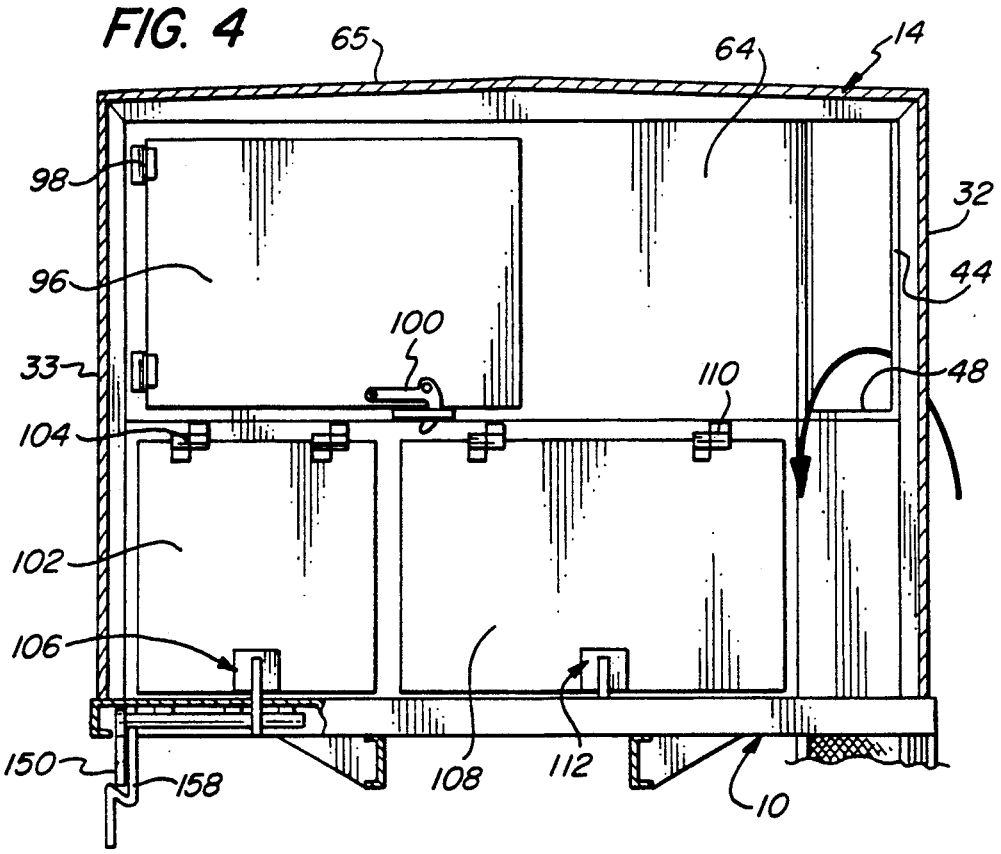
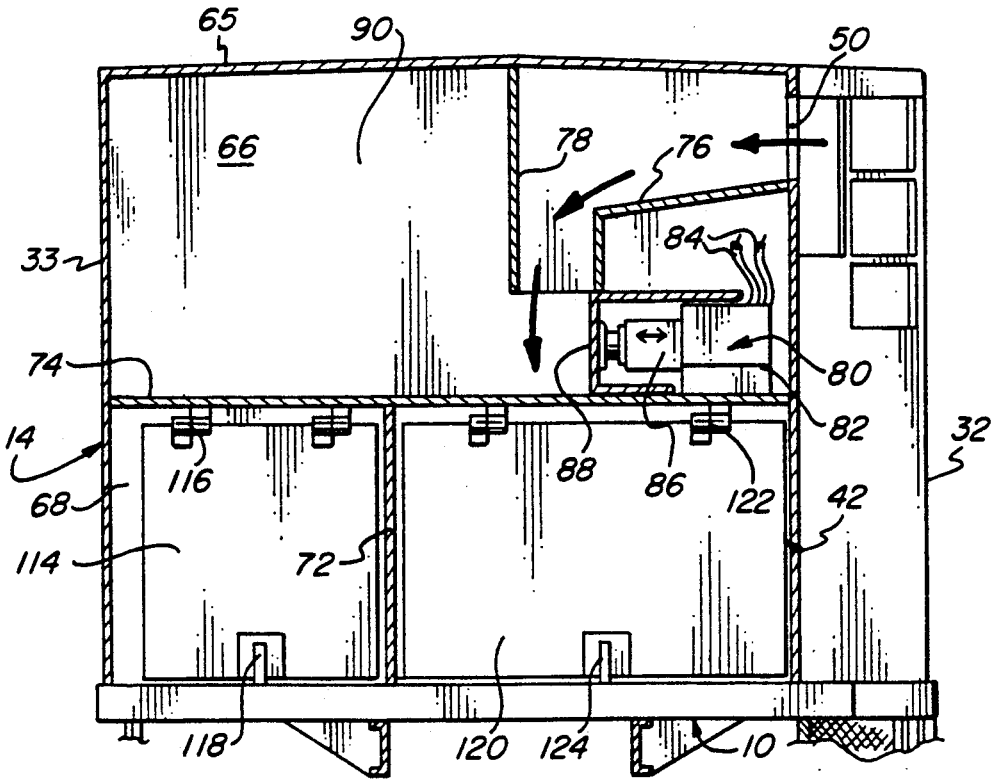
FIG. 5

TRUCK WITH MULTIPLE STORAGE COMPARTMENTS FOR SEPARATELY RECEIVING AND DISCHARGING RECYCLABLE MATERIALS

BACKGROUND OF THE INVENTION

The present invention relates to trucks for collecting refuse, and, more particularly, to trucks for separately collecting and transporting recyclable materials.

In recent years, many communities and states have developed programs for segregation and collection of recyclable materials so as to minimize consumption of natural resources and exhaustion of landfills. In a number of states and communities, programs for recycling have been mandated, and there has been an increase in need for refuse collection trucks which would permit expeditious pick-up and temporary segregated storage of the recyclable materials, and ultimate discharge at collection centers maintained by the community.

To achieve this result, various mechanisms have been proposed for addition to refuse trucks to segregate the collected recyclable materials and ultimately to discharge such materials. Unfortunately, many of the proposed mechanisms have been relatively complicated and expensive to build and to operate. Still others have required a high degree of handling by the operator of the materials both in loading the materials onto the truck and thereafter in removing the materials from the truck at the municipal collection site.

It is an object of the present invention to provide a novel truck for expeditiously collecting, storing in segregated areas, and discharging a variety of recyclable materials.

It is also an object to provide such a truck which may be fabricated readily from rugged materials to provide a long lived structure.

Another object is to provide such a truck in which the operator may readily and separately store the collected recyclables in compartments within the truck and separately discharge the materials from the compartments into storage containers at the municipal collection site with a minimum of handling.

Still another object is to provide such a truck incorporating an internal compartmental structure which may be adjusted to suit the needs of a particular community or of a particular collection route.

A further object is to provide a novel method for rapidly and easily collecting, storing and discharging recyclable materials at collection centers.

SUMMARY OF THE INVENTION

It has now been found that the foregoing and related objects may be readily attained in a truck for separately storing and discharging recyclable materials, by providing on the truck chassis, a container housing with at least one door in the rear wall of the container housing. Partitioning members divide the interior space of the container housing into at least two pairs of transversely disposed compartments, one pair being disposed rearwardly of the other pair, and the rearward pair being spaced from the rear wall of the container housing to define a fifth compartment. The partitioning members between the pairs have gates therein, and the rearward partitioning members of the rearward pair have a gate therein for each rearward compartment.

A multiplicity of openings are provided in one side wall of the container housing with one pair of openings communicating with the compartments of the pairs adjacent the one wall and a second pair communicating with the remote compartments of the pairs. A fifth opening communicates with the fifth compartment. Thus, five types of recyclable materials may be separately stored and thereafter separately discharged by first opening the rear door to discharge the material in the fifth compartment, and then selectively opening the gates of the rearward compartments and thereafter the gates to the forward compartments.

Preferably, each of the gates has a locking mechanism for holding it in a closed position and a remote release mechanism for unlocking the mechanism and opening the gate. The locking mechanism includes a cam element to move the gate into a closed position, and the remote release mechanism includes a mechanical linkage actuatable externally of the truck housing.

In one embodiment, the side wall of the container housing has an alcove about which the openings are disposed, and the truck includes a platform below the alcove and upon which a person may stand to feed materials through the openings.

Desirably, there is a compactor in the container housing operable within one compartment to compact recyclables introduced thereinto, and one of the openings in the container housing communicates therewith. In the preferred embodiment, the compactor is spaced above the rearward pair of compartments in a sixth compartment, and the rearward wall thereof has a gate therein for discharge of its contents. The compactor is disposed adjacent the one side wall, and it has a compacting member movable transversely of the container housing. A chute extends from a sixth opening to discharge materials into the area into which the compactor member is movable.

The preferred truck assembly includes power means for raising and lowering the forward end of the container housing whereby the material in the compartments may be discharged by gravity through the rear door. Chutes extend from the openings to the remote compartments.

In use of the truck for collecting and thereafter discharging into a storage area recyclable materials, there are collected and introduced different types of recyclable materials through the openings into separate compartments for each type. A storage area is also provided at a storage site and it has separate storage units for each type of recyclable material. The material is discharged from the fifth compartment into one of the storage units by moving the truck to the one unit, elevating the forward end and opening the rear door, thus causing the materials to slide out the open rear door and into the storage unit. The truck is then moved, seriatim, to the other storage units and the gates of the compartments associated therewith are opened to discharge the materials into the associated storage units. In this method, the locking mechanism holding each gate in a closed position is released to open the gate. The preferred method utilizes a truck with a compactor and the compactor is operated periodically to compact recyclable materials.

BRIEF DESCRIPTION OF THE DRAWINGS

FIG. 4 is a vertical sectional view thereof along the line 4—4 of FIG. 3;

FIG. 5 is a vertical sectional view thereof along the line 5—5 of FIG. 3;

DETAILED DESCRIPTION OF THE ILLUSTRATED EMBODIMENT

Figure 1:
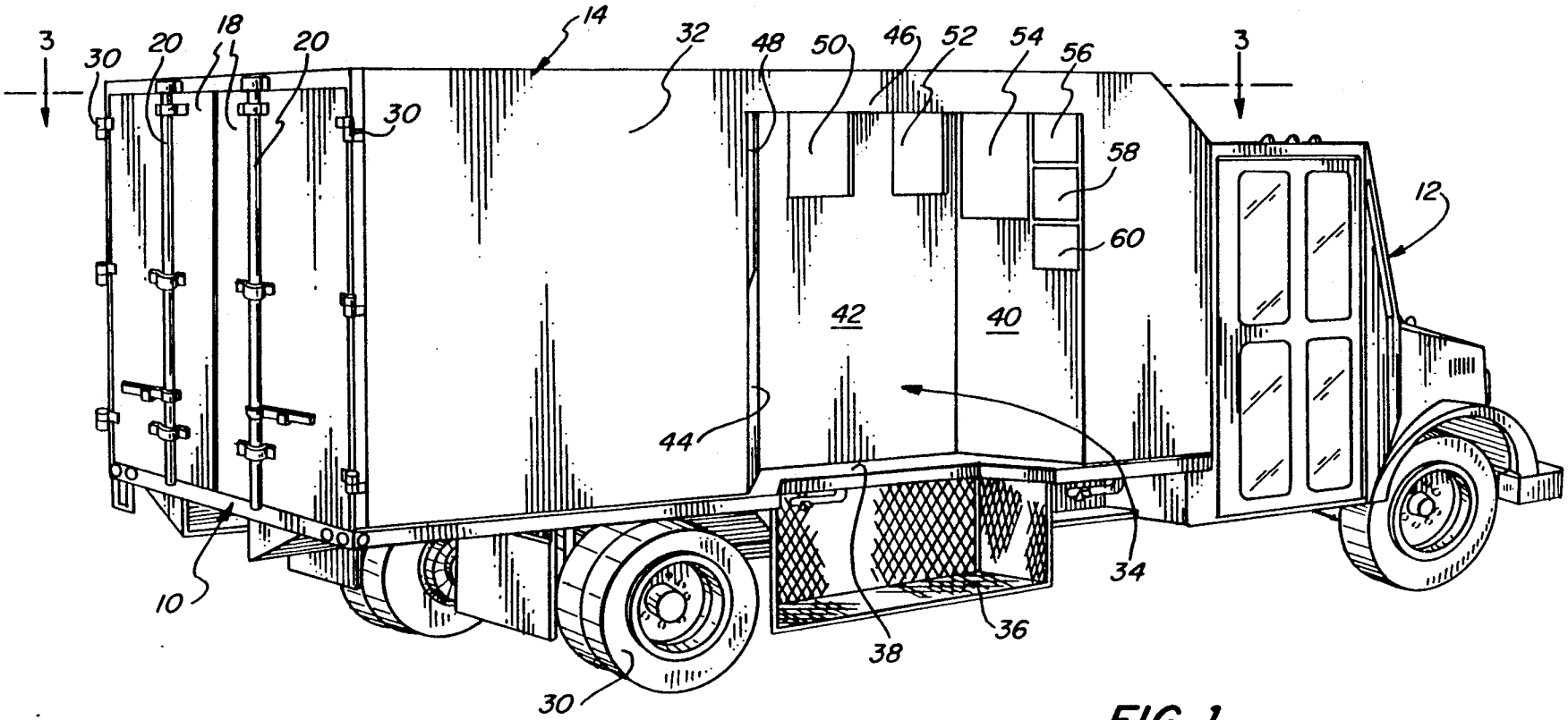
FIG. 1 is a perspective view of a truck for collecting recyclables which embodies the present invention.
Figure 2:
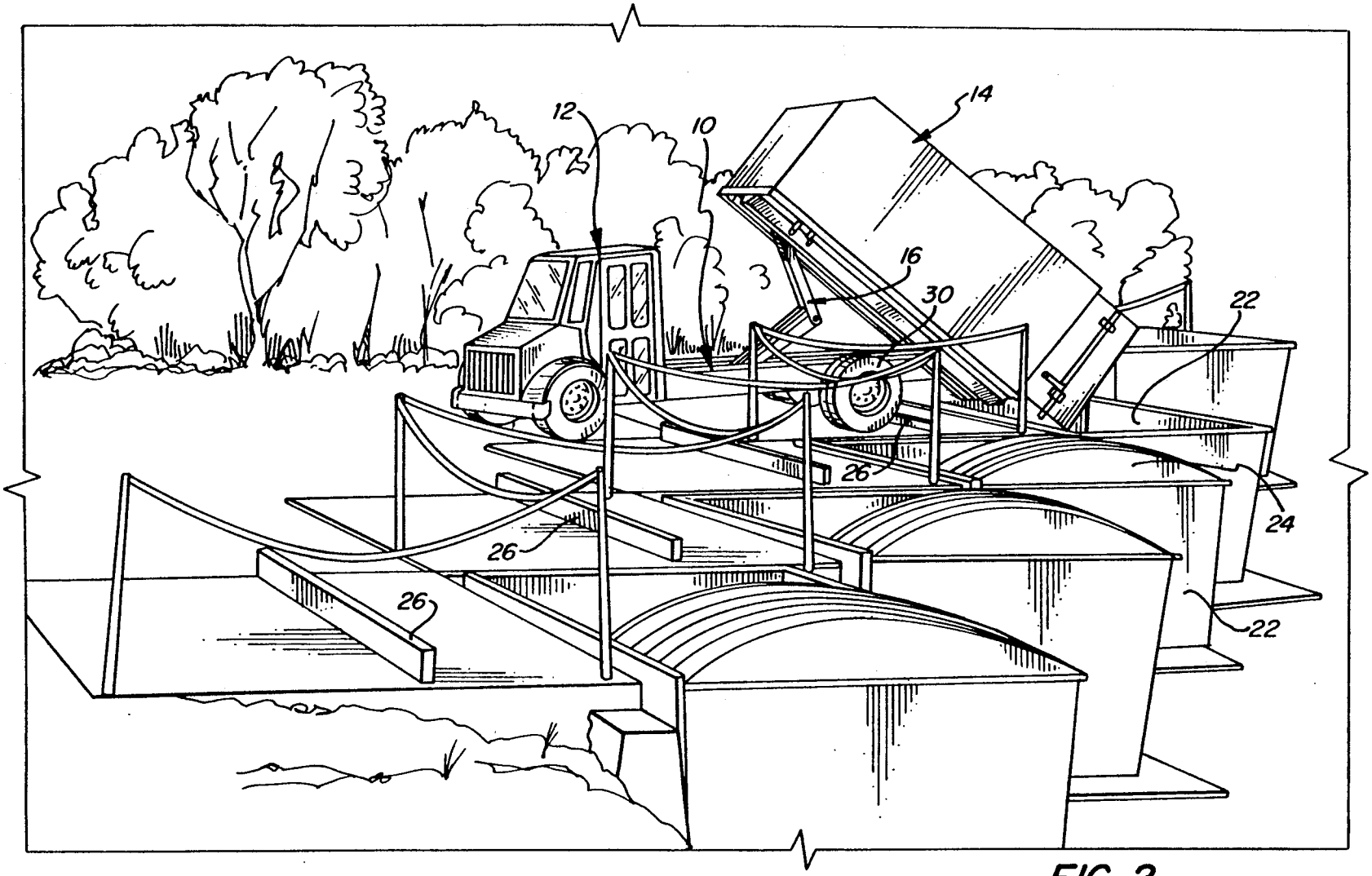
FIG. 2 is a perspective view of the truck of FIG. 1 in the process of discharging the contents of one compartment into a storage bin for that particular recyclable element.

Turning first to FIGS. 1 and 2, therein illustrated is a truck embodying the present invention which has a conventional truck chassis generally designated by the numeral 10, a cab generally designated by the numeral 12, and a container housing generally designated by the numeral 14. As seen in FIG. 2, the container housing 14 may be pivoted upwardly and downwardly by a hydraulic mechanism generally designed by the numeral 16. The container housing 14 has a pair of rear doors 18 in its rear wall which are mounted on hinges 30 and which are locked in closed position by the lock bars 20.

As seen in FIG. 2, the doors 18 at the rear of the truck may be opened by releasing the lock bars 20, and the hydraulic mechanism 16 utilized to pivot the entire storage container 14 upwardly so as to discharge material within the storage container 14 into one of the selected group of bins 22. Each of the bins 22 is dedicated to a particular type of recyclable material and is provided with a removable or displaceable cover 24. To facilitate alignment of the truck in the proper position for discharging its contents into the bins 22, stops 26 are provided on the drive surface, and the rear wheels 30 abut thereagainst.

Returning to FIG. 1, intermediate the length of the sidewall 32 is formed an alcove generally designated by the numeral 34 with a platform 36 upon which the operator may stand during the process of placing the recyclable materials into the truck. The truck is also configured to provide a step 38 above the platform 36, and a canopy 46 is provided thereover to provide protection for the operator as he or she is placing materials in the separate openings as will be described hereafter.

The alcove 34 is essentially defined by three rectilinear walls 40, 42 and 44 which have formed therein a series of openings 48, 50, 52, 54, 56, 58 and 60.

Turning now to FIGS. 3-7, therein illustrated is the general interior construction of the container housing 14 which is divided into a series of compartments by repositionable dividing walls as will be described more fully hereinafter. The bulk of the rearward portion of the container housing is open so that large amount of material may be stored in this open compartment 62 upon the bed 63.

Extending transversely of the container housing 14 between the sidewall 33 and the alcove wall 42, is a rear partition wall 64. Extending forwardly therefrom, and transversely between the sidewall 33 and the alcove walls 40, 42, and forward portion of the sidewall 32 is a horizontally disposed partitioning member 74. Extending between the top wall 65 of the container housing 14 and the horizontal positioning member 74, is a vertically disposed partitioning wall 66 which extends between the sidewall 33 and alcove wall 42.

Figure 3:
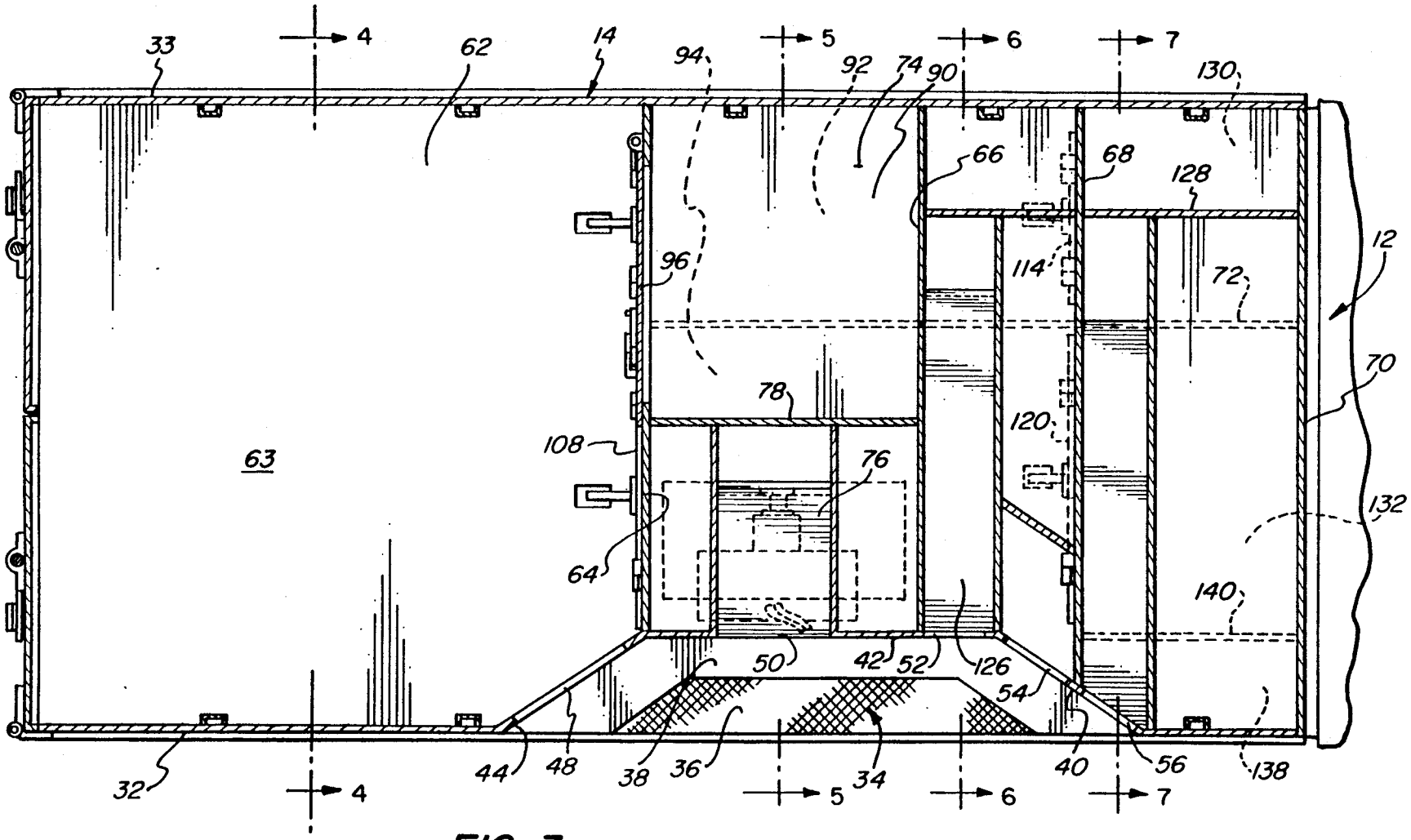
FIG. 3 is a fragmentary transverse sectional view of the storage container of the truck, drawn to an enlarged scale.
Figure 6:
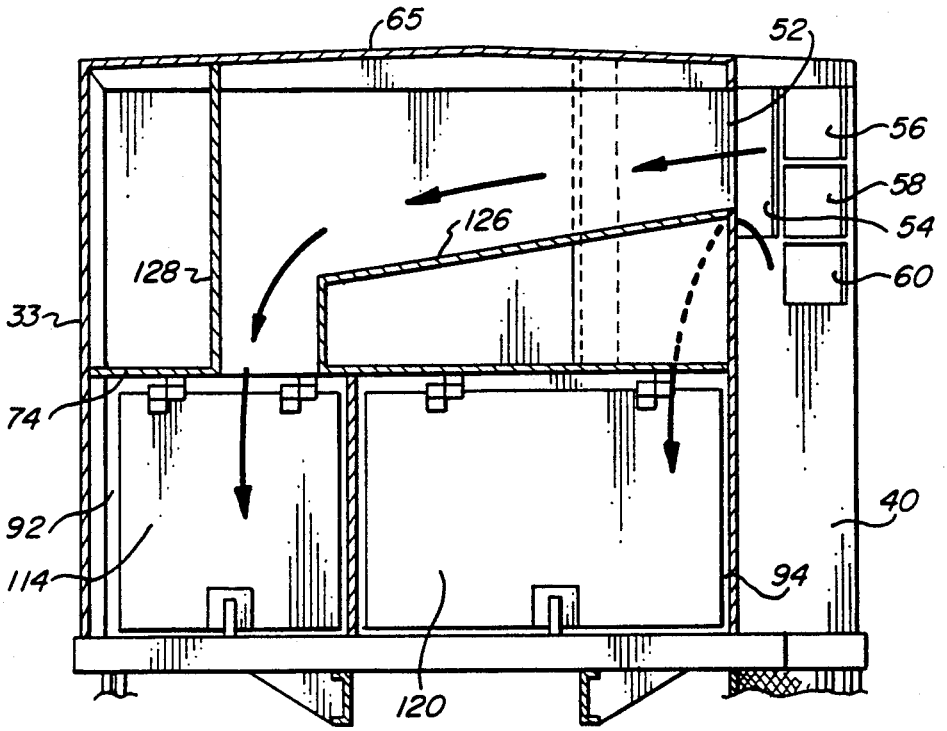
FIG. 6 is a vertical sectional view thereof along the line 6—6 of FIG. 3.
Figure 7:
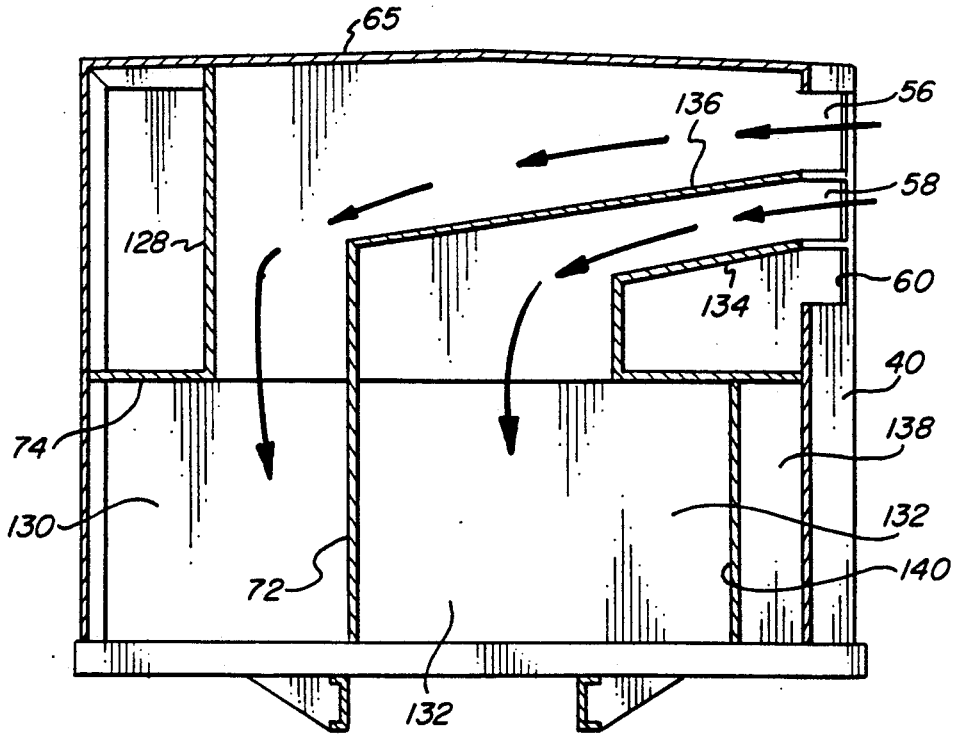
FIG. 7 is a vertical sectional view thereof along the line 7—7 of FIG. 3.

Extending vertically from the rear partitioning wall 64 to the front wall 70, is the main divider wall 72 shown in phantom line. Extending vertically between the sidewall 33 and the alcove wall 40 is the front partitioning wall 68. Extending between the front partitioning wall 68 and the front wall 65, adjacent the sidewall 32, is a short partitioning wall 140, shown in phantom line. In FIG. 5, there is also seen a depending vertically oriented wall 78 extending downwardly from the top wall 65 to divide the space in the rearward area above the horizontal wall 74 As seen in FIGS. 3, 6 and 7, a depending vertically oriented wall 128 extends downwardly to the horizontal wall 74, and it extends rearwardly from the front wall 70 to the front partitioning wall 68 and from that wall to the rear partitioning wall 66.

By this series of walls, the forward portion of the container housing is divided into a series of compartments, namely, the left rear compartment 92 and right rear compartment 94 defined by the rear partitioning wall 64, front partitioning wall 68, and main divider wall 72, and disposed below the horizontal partitioning member 74. Spaced above the horizontal partitioning member 74 and defined between the rear partitioning wall 64 and front partitioning wall 66 is an upper compartment 90. Defined between the front partitioning wall 68, front wall 70, main divider 72 and short partitioning wall 140 are the left front and right front compartments 130 and 132. The short partitioning wall 140 divides the forward section so as to provide an optional compartment 138 adjacent the sidewall 32.

As seen in FIG. 4, the rear partitioning wall 64 has three gates or doors therein. The gate 96 is hingedly mounted on the rear partitioning wall by the hinges 98, and is latched by the pivoted latch arm 100. When it is opened, material stored in the top compartment 90 can be discharged therethrough.

Below the horizontal wall 74 are the gate 102 which is mounted thereon by the hinges 104, and locked by the latch generally designated by the numeral 106, and the gate 108 which is mounted on the hinges 110 and locked by the latch generally designated by the numeral 112. When these doors or gates are opened, material can be discharged from the left rear and right rear compartments 92 and 94.

As seen in FIG. 5, the front partitioning wall 68 has a gate 114 which is mounted by the hinges 116 and locked by the latch 118, and a gate 120 which is mounted by the hinges 122 and locked by the latch 124. When these gates are opened, material may be discharged from the front compartments 130 and 132.

As also seen in FIG. 5, a chute 76 is provided to guide materials introduced through the opening 50 into the compartment 90. Mounted on the horizontal wall 74 is a compactor mechanism generally designated by the numeral 80, and including a motor 82 which is powered by the power supply conduits 84 and operable to move a telescoping piston 86 which moves a compacting head 88 into the compartment 90 to compress materials received therewithin. The movement of the piston is diagrammatically illustrated by the double headed arrow thereon. The vertical wall 78 causes the material introduced onto the chute 76 to fall to a position directly in front of the compacting head 88.

Returning to FIG. 4, it can be seen that the opening 48 in the wall 44 directly communicates with the rear compartment 62 for introduction of material thereinto. As discussed above, the opening 50 and the chute 76 provide means for introducing material into the compartment 90.

Returning now to FIG. 3 and concurrently referring to FIG. 6, a chute 126 extends from the opening 52 and discharges into the left rear compartment 92. The opening 54 communicates with a downward passage into the right rear compartment 94.

As seen from the combination of FIGS. 3 and 7, the opening 56 cooperates with a chute 136 to deliver material to the left front compartment 130, and the opening 58 cooperates with the chute 134 to deliver material to the right front compartment 132.

In the illustrated embodiment, an optional opening 60 is provided which allows material to drop directly into an optional compartment 138 located immediately adjacent the sidewall 38. To effect removal of materials stored in this compartment, an access door (not shown) is provided in the sidewall 32.

Figure 8:
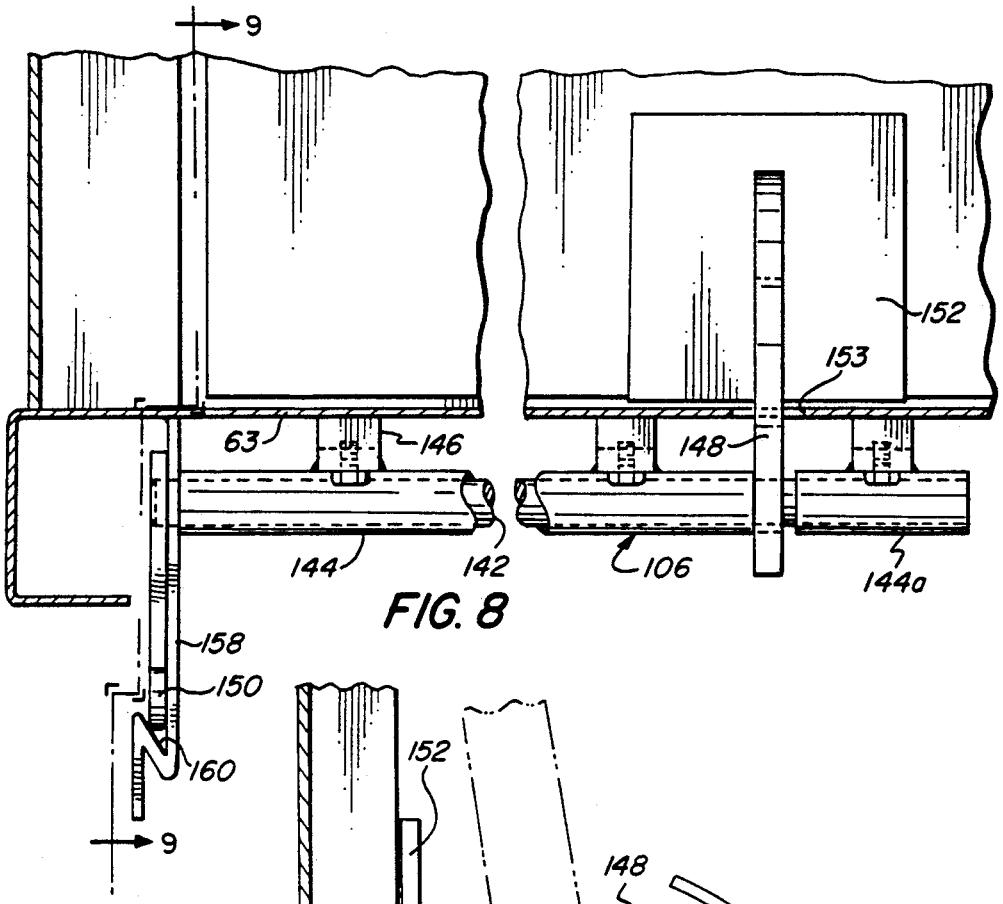
FIG. 8 is an enlarged fragmentary cross sectional view of the truck showing a compartment wall with gate and the mechanism for effecting locking of the gate in the closed position and thereafter effecting its release remotely.
Figure 9:
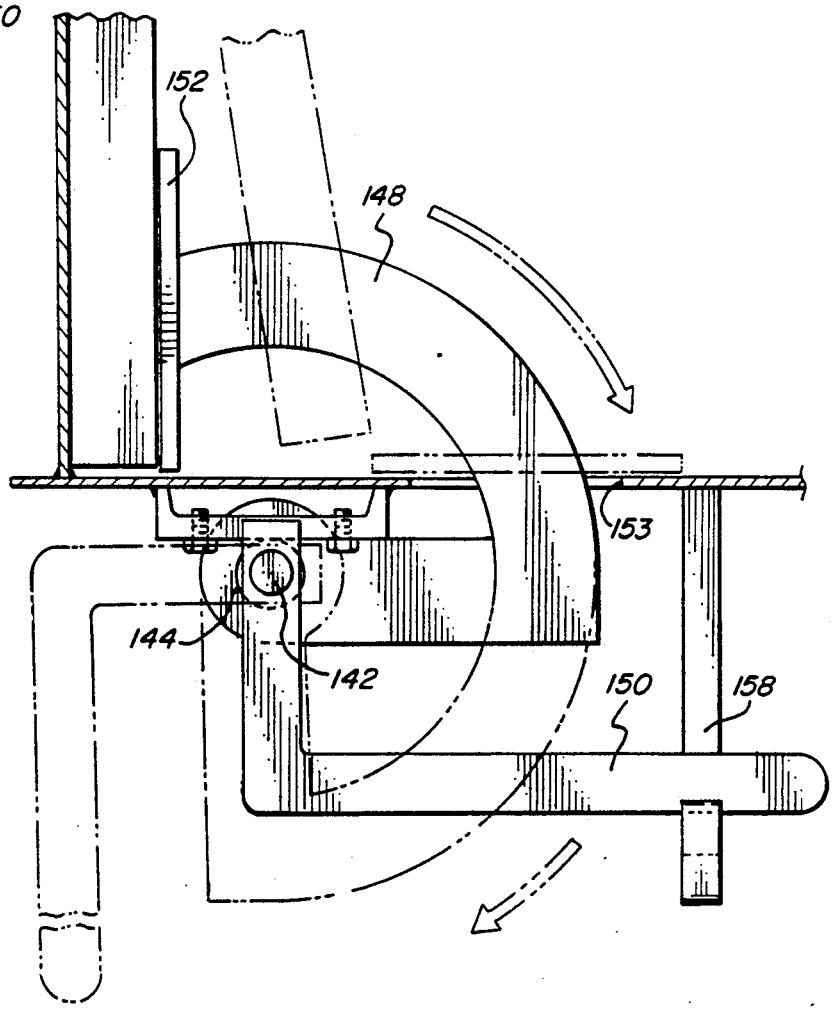
FIG. 9 is a fragmentary sectional view along the line 9—9 of FIG. 8 showing the gate and mechanism in the full closed position in solid line, and in an open position in phantom line.

Turning now to FIGS. 8 and 9 therein illustrated is the remotely operable mechanism for closing and locking the several gates to the right and left lower compartments 92, 94, 130 and 132. The figures specifically illustrate the mechanism for locking the gate or door 102 to the left rear compartment 92, i.e., the latch mechanism 106 as seen in FIG. 4. The latch mechanism includes a rotatable shaft 142 which is carried in a horizontal position by the long tubular support 144 and short tubular support 144*a* which is secured to the bottom of the bed 63 by brackets 146 spaced along the length of the tubular support 144.

Mounted on the shaft 142 between the long tubular support 144 and the short tubular support 144*a* is the operator arm 148 which has a rectilinear section extending from the shaft 142, and an arcuate section extending upwardly therefrom through an aperture 153 in the bed 63. At the end of the arcuate section is the lock plate 152 which bears against the gate 102 to force it into a closed position and thereafter to hold it in a closed position.

To effect rotation of the shaft 142 and thereby the operator arm 148, the shaft 142 projects beyond the end of the tubular support 144 and has mounted thereon an actuator arm 150 of generally L-shaped configuration. As seen in FIG. 9, movement of the actuator arm 150 from the position shown in full line to the position shown in phantom line will rotate the shaft 142 and remove the lock plate 152 from a position bearing against the gate 102, thus allowing it to pivot into an open position when the container housing 14 as seen in phantom line, is pivoted upwardly. Conversely, rotation of the shaft from the position seen in phantom line to the position shown in solid line will cam the gate or door 102 into the closed position from the partially open position seen in phantom line.

To hold the door in latched position, a support member 158 depends from the bed 63 and has a recess 160 formed therein to seat the actuator arm 150. There is sufficient play in the mounting of the shaft 142 and of the actuator arm 150 to allow the actuator arm 150 to be removed from the recess 160 to effect the rotation when desired.

Turning to use of the illustrated embodiment of the truck of the present invention, conveniently the openings and the compartments therein are utilized as follows: The opening 48 is used to introduce paper into the large rear compartment 62 provided between the rear partition wall 64 and the doors 18. Thus, paper is the first item to be discharged into a storage bin 22 and generally comprises the largest volume of recyclable materials which will be collected in a normal urban environment.

The opening 50 which communicates with the compartment 90 is utilized to introduce synthetic resin products such as plastic bottles and boxes. These slide down the chute 76 into the compartment 90 forwardly of the compactor head 88. Periodically, the compactor mechanism 80 is actuated by hydraulic fluid introduced through one of the hoses 84 to drive the motor 82 and moving the piston 86 forwardly. This causes the compactor head 88 to crush or compress the synthetic resin articles within the compartment 90.

The opening 52 cooperates with the slide 126 to transport clear glass bottles into the left rear compartment 92. Through the opening 54, cans are dropped directly downwardly into the right rear compartment 94.

Green and brown glass bottles are separately introduced through the openings 56 and 58 and travel along the chutes 136 and 134 into the left front compartment 130 and right front compartment 132 respectively.

Provision has been made for another storage compartment to segregate still a different type of recyclable material by introducing it through the opening 60, and it will drop downwardly into the compartment 138 which is formed adjacent the sidewall 32. If this compartment is employed, a door (not shown) is provided in the sidewall 32 or alcove wall 40 to permit removing contents of this compartment manually.

As will be appreciated, the operator may step onto the platform 36 or onto the step 38 thereabove to effect the sorting and placement of the recyclable materials being collected into the respective openings. During this period of time, the operator is shielded from the elements by the overhang or canopy 46 above the alcove 34.

After the truck has completed its route, it then travels to the recycling center and is backed up to the first of the storage bins. The lock bars 20 for the doors 18 are moved to the release position to allow the doors 18 to be opened, and the hydraulic mechanism 16 is actuated to elevate the container housing 14 into the position seen in FIG. 2. This causes the paper to be discharged into the first bin 22. As seen in FIG. 2, the truck has been backed up until the rear tires 30 abut the stop 26 adjacent the storage bin 22.

After the paper has been discharged, the hydraulic mechanism 16 is actuated to lower the container housing 14, and the truck is moved into alignment with the second storage bin 22 and one of the gates 96, 102 or 108 is opened to discharge the contents of the top or rear compartments as the case may be. Generally, all three of the rear compartments are discharged seriatim although it is possible to discharge one rear compartment and then open the gate to the forward compartment to effect discharge of its contents before opening the adjacent rear compartment. The sequence is a matter of choice from the standpoint of the orientation of the storage bins 22 at the recycling center.

As will be readily appreciated, it is desirable to be able to open the gates from the exterior of the truck so that a person does not have to enter the truck to open the several gates. This is particularly true with respect to the gates to the front compartment which would require entering the rear compartments to do so. Although electrical and electromechanical latches and hydraulic latches may be employed to permit remote operation, the potential for injury to hydraulic lines and electric lines is such that a simple, mechanical linkage is desirable to permit remote operation from the sides of the truck.

Such a mechanical system is that illustrated in FIGS. 8 and 9, and, as can be seen in FIGS. 1, 4 and 8, the actuator arm 150 is readily accessible from the side of the truck to open the gates. Moreover, it will be seen that the gates for the lower compartments are all hinged at the top so that the weight of the door will tend to move the door or gate into the closed position when the container housing is in a horizontal position. The actuator arm moves through an arcuate path and will force the door or gate into a closed position even when small amounts of material are disposed in the path of closing action since there is a substantial multiplication of the force exerted by the operator through the long actuator arm.

The compartment walls within the container housing are conveniently fabricated from sheet metal seated in channel elements to effect positioning. Desirably, a series of channel elements are provided at spaced points to allow repositioning of the partitioning walls to increase or decrease the size of the various compartments as found to be necessary in a particular route or community.

It will be appreciated that the latch 100 for the top compartment containing plastic materials in the illustrated embodiment may also be remotely actuated by an actuating lever extending through the sidewall 33 or by an electromechanical or hydraulic mechanism.

The compactor motor 82 is desirably powered by hydraulic fluid from the truck's hydraulic system. However, electrical power may also be employed if so desired.

It has been found that the arrangement of the compartments in the illustrated embodiment is such that it permits facile cleaning of the storage compartments. Moreover, the small number of moving parts within the container housing minimizes the amount of maintenance required since the elements are of mechanical character with the exception of the compactor motor which is separately disposed within a relatively protected enclosure.

Thus, it can be seen from the foregoing detailed specification and attached drawings that the truck of the present invention provides a simple means for collecting and temporarily storing recyclable materials and for discharging those materials separately at a recycling center. The truck may be readily fabricated from components which will provide a long lived, relatively trouble-free structure. Moreover, the collection and discharge of materials may be effected by a single operator if so desired with a minimal requirement for handling of the materials if segregated by the household owners.

Having thus described the invention, what is claimed is:

1. A truck for separately storing and discharging recyclable materials comprising:

(a) a truck having a chassis with front and rear ends;

(b) a container housing mounted on said chassis and having front and rear walls;

(c) at least one door in the rear wall of said container housing;

(d) partitioning members in said container housing dividing the interior space into at least two pairs of transversely disposed compartments, one pair being disposed rearwardly of the other pair, and the partitioning members therebetween having a gate therein for each forward compartment to provide a passage between the forward and rearward compartments, said rearward pair being spaced from said rear wall of said container housing to define a fifth compartment, and the rearward partitioning members of said rearward pair having a gate therein for each rearward compartment; and (e) a multiplicity of openings in one side wall of said container housing, one pair of said openings communicating with the compartments of said pairs which are adjacent said one side wall, a second pair of said openings communicating with compartments of said pairs which are remote from said one side wall, and a fifth opening communicating with said fifth compartment, whereby five types of recyclable materials may be separately stored and thereafter separately discharged by first opening said rear door to discharge the material in said fifth compartment, and then selectively opening said gates of the rearward compartments and thereafter the gates to the forward compartments.

2. The truck in accordance with claim 1 wherein each of said gates has a locking mechanism for holding it in a closed position and a remote release mechanism for unlocking said mechanism and opening said gate.

3. The truck in accordance with claim 2 wherein said locking mechanism includes a cam element to move the gate into a closed position.

4. The truck in accordance with claim 2 wherein said remote release mechanism includes a mechanical linkage actuatable externally of said truck housing.

5. The truck in accordance with claim 1 wherein said one side wall of said container housing has an alcove about which said openings are disposed.

6. The truck in accordance with claim 5 wherein said truck includes a platform below said alcove and upon which a person may stand to feed materials through said openings.

7. The truck in accordance with claim 1 wherein there is included a compactor in said container housing operable within a compartment to compact recyclables introduced thereinto, and one of said openings in said container housing communicates therewith.

8. The truck in accordance with claim 7 wherein said compartment with said compactor is spaced above said rearward pair of compartments in a sixth compartment, and the rearward wall thereof has a gate therein for discharge of its contents.

9. The truck in accordance with claim 7 wherein said compactor is disposed adjacent said one side wall and has a compacting member movable transversely of said container housing.

10. The truck in accordance with claim 9 wherein a chute extends from a sixth opening to discharge materials into the area into which said compactor member is movable.

11. The truck in accordance with claim 1 including power means for raising and lowering the forward end of said container housing whereby the material in said compartments may be discharged by gravity through said rear door.

12. The truck in accordance with claim 1 wherein chutes extend from said openings to said compartments of said pairs spaced from said one wall.

13. A truck for separately storing and discharging recyclable materials comprising:

(a) a truck having a chassis with front and rear ends;

(b) a container housing mounted on said chassis and having front and rear walls;

(c) at least one door in the rear wall of said container housing;

(d) partitioning members in said container housing dividing the interior space into at least two pairs of transversely disposed compartments, one pair being disposed rearwardly of the other pair, and the partitioning members therebetween having a gate therein for each forward compartment to provide a passage between the forward and rearward compartments, said rearward pair being spaced from said rear wall of said container housing to define a fifth compartment, and the rearward partitioning members of said rearward pair having a gate therein for each rearward compartment, said partitioning members providing a sixth compartment above said rearward pair;

(e) a compactor in said container housing operable within said sixth compartment to compact recyclables introduced thereinto; and (f) a multiplicity of openings in one side wall of said container housing, one pair of said openings communicating with the compartments of said pairs which are adjacent said one side wall, a second pair of said openings communicating with compartments of said pairs which are remote from said one side wall, a fifth opening communicating with said fifth compartment, and a sixth opening in said container housing communicating with said sixth compartment, the rearward wall of said sixth compartment having a gate therein for discharge of its contents, whereby six types of recyclable materials may be separately stored and thereafter separately discharged by first opening said rear door to discharge the material in said fifth compartment, and then selectively opening said gates of the rearward compartments and thereafter the gates to the forward compartments.

14. The truck in accordance with claim 13 wherein said compactor is disposed adjacent said one side wall and has a compacting member movable transversely of said container housing.

15. The truck in accordance with claim 14 wherein a chute extends from said sixth opening to discharge materials into the area of said sixth compartment into which said compactor member is movable.

16. The truck in accordance with claim 13 wherein each of said gates for said two pairs of compartments has a locking mechanism for holding it in a closed position and a remote release mechanism for unlocking said mechanism and opening said gate.

17. The truck in accordance with claim 16 wherein said locking mechanism includes a cam element to move the gate into a closed position.

18. The truck in accordance with claim 17 wherein said remote release mechanism includes a mechanical linkage actuatable externally of said truck housing.

19. The truck in accordance with claim 13 wherein said one side wall of said container housing has an alcove about which said openings are disposed.

20. The truck in accordance with claim 19 wherein said truck includes a platform below said alcove and upon which a person may stand to feed materials through said openings.

21. The truck in accordance with claim 13 including power means for raising and lowering the forward end of said container housing whereby the material in said compartments may be discharged by gravity through said rear door.

22. A method for collecting and thereafter discharging into a storage area recyclable materials comprising:

(a) providing a truck having (i) a container housing with at least one door in the rear wall of said container housing (ii) partitioning members dividing the interior space of said container housing into at least two pairs of transversely disposed compartments, one pair being disposed rearwardly of the other pair, (iii) gates in the partitioning members between the forward and rearward compartments, said rearward pair being spaced from said rear wall of said container housing to define a fifth compartment, (iv) gates in the rearward partitioning members of said rearward pair, and (v) a multiplicity of openings in one side wall of said container housing each communicating with one of said compartments;

(b) collecting and introducing different types of recyclable materials through said openings into compartments for each of said types;

(c) providing a storage area with separate storage units for each type of recyclable material;

(d) discharging the material from said fifth compartment into one of said storage units by moving the truck to said one unit, elevating the forward end and opening the rear door, thus causing the materials to slide out the open rear door into said storage unit; and (e) moving the truck, seriatim, to the other storage units and opening the gate of the compartment associated therewith to discharge the materials into the associated storage unit.

23. The method in accordance with claim 22 wherein there is included the steps of releasing a locking mechanism holding each gate in a closed position to open the gate.

24. The method in accordance with claim 22 wherein there is included the steps of providing a compactor in said container housing operable within a compartment to compact recyclables introduced thereinto, and operating said compactor periodically to compact recyclable materials.

* * * * *